US007192330B2

(12) United States Patent
Van Dan Elzen

(10) Patent No.: US 7,192,330 B2
(45) Date of Patent: Mar. 20, 2007

(54) YO-YO HAVING ADJUSTABLE RESPONSIVENESS

(76) Inventor: Hans W. Van Dan Elzen, 4750 S. Station Dr., Gilbert, AZ (US) 85297

( * ) Notice: Subject to any disclaimer, the term of this patent is extended or adjusted under 35 U.S.C. 154(b) by 0 days.

(21) Appl. No.: 11/053,490

(22) Filed: Feb. 8, 2005

(65) Prior Publication Data

US 2006/0178083 A1 Aug. 10, 2006

(51) Int. Cl.
*A63H 1/30* (2006.01)
*A63H 1/06* (2006.01)

(52) U.S. Cl. ..... 446/250; 446/247

(58) Field of Classification Search ..... 446/247–254, 446/261–262

See application file for complete search history.

(56) References Cited

U.S. PATENT DOCUMENTS 5,254,027 A * 10/1993 McAvoy, Jr. ..... 446/250
5,389,029 A * 2/1995 McAvoy, Jr. ..... 446/250
5,961,366 A * 10/1999 Wei ..... 446/250
6,066,024 A 5/2000 McAvoy, Jr.
6,077,145 A * 6/2000 Ma ..... 446/250
6,162,109 A * 12/2000 Baier ..... 446/250
6,331,132 B1 * 12/2001 Watson ..... 446/250
6,354,905 B1 * 3/2002 Haines et al. ..... 446/250
6,579,142 B1 * 6/2003 Rehkemper et al. ..... 446/247

* cited by examiner

*Primary Examiner*—Eugene Kim
*Assistant Examiner*—Alyssa M. Lowen
(74) *Attorney, Agent, or Firm*—Franklin Gubernick

(57) ABSTRACT

The invention is a yo-yo that includes features that enable a user to adjust the yo-yo's responsiveness. Each of the yo-yo's sides has a movable shuttle having a tether engagement surface. By changing the position of one or both shuttles, a user can affect the yo-yo's ability to return on command. Preferably, the yo-yo also includes readily visible indicia associated with the shuttle's positioning apparatus so that a user can easily set and/or ascertain the yo-yo's responsiveness setting. A user can also change the yo-yo's responsiveness by replacing one set of shuttles with another set that has different tether engagement adaptations. The yo-yo may also include a conventional adjustable string gap and removable rim members.

23 Claims, 8 Drawing Sheets

YO-YO HAVING ADJUSTABLE RESPONSIVENESS

FIELD OF THE INVENTION

The invention is in the field of user-manipulated toys. More particularly, the invention is a yo-yo that includes unique features that enable a user to adjust the yo-yo's responsiveness. In the preferred embodiment, each of the yo-yo's side members has a center-located shuttle that may be adjustably positioned by a user. The shuttle includes a tether engagement surface specifically designed for engagement with the yo-yo's tether. By appropriate positioning of the shuttle, a user adjusts the yo-yo's ability to return on command and also its sensitivity to inadvertent contacts between the tether and a portion of the yo-yo when said yo-yo is spinning. Preferably, the yo-yo also includes readily visible indicia that facilitates both shuttle adjustment and the ability of a user to ascertain the yo-yo's responsiveness setting.

BACKGROUND OF THE INVENTION

Most yo-yos are in the form of two disk-shaped side members that are rigidly connected to each other by some type of axle structure. The axle structure may be an assembly of multiple parts, or merely be in the form of a dowel or a riveted pin, and may be made of metal and/or wood and/or plastic. In many modern yo-yos, the axle structure includes a center-located bearing or other member that is rotatable on an elongated axle member.

The axle structure also forms an anchor for one end of a string-type tether. An end-located loop portion of the tether is positioned so that it encircles a center portion of the axle structure. The free end of the tether is usually tied to create a second loop portion that can be placed about one of a user's fingers to thereby secure the yo-yo to the user.

When the tether is wound about the axle structure and the yo-yo is released or thrown from the user's hand, the yo-yo will begin to rapidly spin as it moves away from the user's hand and the tether unwinds from the axle structure. Once the tether is fully unwound, the yo-yo may "sleep" at the end of the tether, whereby the yo-yo continues to spin without the tether rewinding on the axle structure. Once the yo-yo is sleeping, there are a number of tricks, such as "walk the dog," that a person can perform with the spinning yo-yo. A sleeping yo-yo is also often used to perform tricks where the spinning yo-yo is temporarily placed upon a portion of the tether intermediate of the tether's two ends.

At the completion of most yo-yo tricks, the user will make a rapid tug/jerk on the tether. This will result in a brief tightening of the tether, which is then automatically followed by a temporary slackening of the tether. Once the tether goes slack, the tether's twist will cause one or more portions of the tether located proximate the axle structure to move, and thereby contact a spinning portion of the yo-yo. Once contact has occurred, the tether portion can become snagged on, or otherwise engaged to, a spinning portion of the yo-yo in a manner whereby rotation of the spinning portion of the yo-yo causes the tether to wind about the axle structure. Winding of the tether on the axle structure causes the yo-yo to return to the user's hand.

There are three crucial performance characteristics of a yo-yo that enable a user to perform yo-yo tricks. The yo-yo must be capable of sleeping for an extended period of time, it should return on command, and it should be smooth on the tether.

Concerning a yo-yo's sleep time, the longer the yo-yo can be made to sleep, the more time the user will have to complete any particular yo-yo trick that requires the use of a sleeping yo-yo. It is well known that by minimizing friction in the yo-yo's components, one can maximize the yo-yo's sleep time. Also, a heavy yo-yo will usually sleep longer than a light one. Furthermore, it is known that whenever the tether even slightly rubs against a spinning portion of the yo-yo, the created friction will reduce the yo-yo's sleep time.

For a yo-yo to return on command, the structure and design of the yo-yo must be such that when the user causes the tether to briefly go slack, a portion of the tether can become snagged on a spinning portion of the yo-yo and thereby cause the yo-yo to return to the user's hand. A yo-yo's responsiveness is hereby defined as the ease with which one can cause the yo-yo to return on command. Responsiveness is also commonly defined by how sensitive the yo-yo is to any contact between the tether and a spinning portion of the yo-yo when the yo-yo is sleeping. A yo-yo can be considered too responsive if the yo-yo returns to the user's hand without the user knowingly causing, or wanting, said return to occur. When such an inadvertent return does happen, the performance of a yo-yo trick will usually be cut short and thereby ruined.

A yo-yo's responsiveness is usually enhanced through the use of particular engagement adaptations, such as raised ribs, on the tether-facing surface of the yo-yo's side members. The tether-facing surface of a side member is herein defined as the surface of the side member that faces a portion of the yo-yo's tether when said tether extends outwardly from the yo-yo. Additionally, a yo-yo's ability to return on command is directly related to the yo-yo's weight, with a light yo-yo usually being easier to get to return than a heavy one. The yo-yo's string gap and axle structure can also affect the yo-yo's ability to return on command. A yo-yo's string gap is herein defined as the area located between the yo-yo's side members.

Concerning a yo-yo's ability to be smooth on the tether, this refers to a yo-yo's ability, when it is sleeping at the end of the tether, to be temporarily placed on a medial portion of the tether without the tether snagging on a spinning portion of the yo-yo. An example of a trick that requires a yo-yo to be smooth on the tether is "man on the trapeze." If, during such a trick, the yo-yo can slide on the tether, the yo-yo is said to be very smooth on the tether/string. The ability of a yo-yo to be smooth on the tether is favored when the yo-yo's responsiveness is low.

One other important consideration involved in the design/performance of a yo-yo is the wear rate of the yo-yo's tether and the portion(s) of the yo-yo that engage said tether. Wear occurs whenever the tether contacts a spinning portion of the yo-yo. While it is easy to replace a tether, replacement of the structure that engages the tether is usually impossible. Once significant wear occurs in the yo-yo's structure, the yo-yo's performance degrades and the yo-yo eventually becomes unusable.

The design of a yo-yo typically involves trade-offs. A yo-yo having physical attributes that make it smooth on the string, such as a wide string gap and a less aggressive tether engagement surface, will normally make the yo-yo less responsive and therefore harder to make return. A very responsive yo-yo, with a narrow string gap and aggressive tether engagement surfaces, may not sleep for a long time and may experience rapid tether wear.

It is not unknown in the prior art to provide ways for a user to change a yo-yo's physical characteristics to thereby change the yo-yo's performance characteristics. The most common method is to provide the yo-yo with structure that enables a user to change the size of the yo-yo's string gap. BY increasing the size of the gap, one can change a yo-yo that will readily return on command to instead be less responsive but be smoother on the tether.

In most conventional yo-yo's, adjustable string gap is accomplished via the yo-yo's axle structure and side member securement method. Both side members are normally threadedly engaged to the axle structure whereby a user can rotate one of the yo-yo's side members relative to the other to thereby change the spacing/string gap between the side members. However, repeated relative movements of the yo-yo's side members can wear out the adjustment apparatus. In addition, this form of adjustment is extremely inexact whereby a yo-yo may require multiple repetitions of the adjustment process before the yo-yo exhibits the desired level of responsiveness. Furthermore, a basic adjustable string gap yo-yo does not allow a user to change the responsiveness of a yo-yo without changing its string gap.

McAvoy teaches in U.S. Pat. No. 5,254,027 a different method for changing a yo-yo's characteristics. He makes use of a moveable lapper disk in each side member. The lapper disk has a tether-facing surface that is flat, smooth and is designed to continually contact the tether. However, the fastener that pushes on the lapper disk does not provide a positive engagement for bi-directional movement of the disk. In addition, the flat, smooth tether-facing surfaces contacting the tether can cause a decrease in the yo-yo's sleep time, an increase in tether wear and may require a user to spend significant time trying to adjust the lapper disks to accomplish a desired change in the yo-yo's responsiveness.

Most prior art yo-yos have designs that limit their versatility. For example, a beginning yo-yo player will pick a highly responsive yo-yo to ensure that it will be easy to get the yo-yo to return on command. A more experienced player wishing to perform string tricks in which smoothness on the string is desirable will normally choose a less responsive yo-yo with a wide string gap. The prior art adjustable yo-yos, while enabling some changes in performance, do not provide a desired level of all-around performance. As a result, many yo-yo players will own a multitude of yo-yos so that he or she can pick the yo-yo having the best mix of characteristics for the performance of any particular trick. However, owning a multitude of yo-yos is costly, and transporting a large number of yo-yos can be bothersome.

SUMMARY OF THE INVENTION

The invention is an improved yo-yo that includes unique features that enable a user to adjust the yo-yo's responsiveness. In the preferred embodiment, each of the yo-yo's two side members includes a movable shuttle secured by a user-actuated positioning apparatus. The shuttle has a tether engagement surface that a user can move closer to, or further away from, the yo-yo's tether. By appropriate setting of the position of the shuttle in one or both of the yo-yo's side members, a user can affect the yo-yo's responsiveness to facilitate the performance of any particular yo-yo trick.

Preferably, each of the yo-yo's side members also includes readily visible indicia associated with the apparatus used for positioning the side member's shuttle. The indicia facilitates a user's ability to set the yo-yo's responsiveness and/or to ascertain the yo-yo's responsiveness setting.

Furthermore, a yo-yo in accordance with the invention provides a second, related method of changing the yo-yo's responsiveness, via replacement of the yo-yo's shuttles. In the invention, a user has the ability to replace one set of shuttles having a first configuration of tether engagement surfaces with a second set of shuttles having a second configuration of tether engagement surfaces. For example, a first set of shuttles may feature very aggressive tether engagement surfaces that have large raised ribs with ninety-degree edges. A second set of shuttles may feature less aggressive tether engagement surfaces that have small raised ribs with rounded, radiused edges. By taking a yo-yo that has the first set of shuttles installed and replacing the shuttles with the above-described second set of shuttles, a user can significantly decrease the yo-yo's responsiveness and make it a better performer for string tricks.

In addition, a yo-yo in accordance with the invention can also include structure to enable a conventional form of adjustable string gap for changing the yo-yo's responsiveness. The yo-yo's side members are preferably relatively rotatable on the axle structure whereby rotation of one side member relative to the other causes the side members to move closer together or further apart, depending on the direction of relative rotation. This feature can facilitate the performance of some tricks.

A yo-yo in accordance with the invention can optionally, but preferably, also feature easily removable rim members. A user then has the ability to modify the yo-yo's weight, shape and to some extent responsiveness through substitution of one set of rim members for another set having a different weight and/or shape. The user can then position the shuttles to compensate, if necessary, for changes created through substitution of one set of rim members for another. For example, it is usually harder for a user to make a heavier yo-yo return than to make a lighter yo-yo return. If a user installs heavier rim members in an effort to improve the yo-yo's sleep time, the user can recapture the yo-yo's previous level of responsiveness by positioning the shuttles closer to the tether.

By preferably featuring multiple ways in which a user can change a yo-yo's responsiveness and other performance characteristics, the yo-yo's range of responsiveness settings, and capability to perform a variety of tricks, is increased. Also, the yo-yo provides a user with the ability to adjust the yo-yo to compensate for different changes in the yo-yo's physical characteristics. In addition, the invention enables a user to have a yo-yo that is very responsive and also has a wide string gap to facilitate catching the yo-yo on a medial portion of the tether. This is accomplished by increasing the spacing between the side members and then adjusting the shuttles inwardly so that the tether can readily engage the tether engagement surface of one or both shuttles.

The use of user-positionable shuttles enables a user to adjust the yo-yo so that its performance characteristics can be tailored to facilitate the performance of any particular yo-yo trick. The yo-yo's indicia facilitates setting the yo-yo's level of responsiveness while also preferably enabling a user to readily ascertain the yo-yo's responsiveness setting. A user wishing to perform a variety of yo-yo tricks is no longer required to own, transport or maintain multiple yo-yos. A yo-yo in accordance with the invention can be adjusted and/or readily modified by a user to enable its use by players of any skill level and for the performance of an almost unlimited range of yo-yo tricks.

DETAILED DESCRIPTION OF THE DRAWINGS

Figure 1:
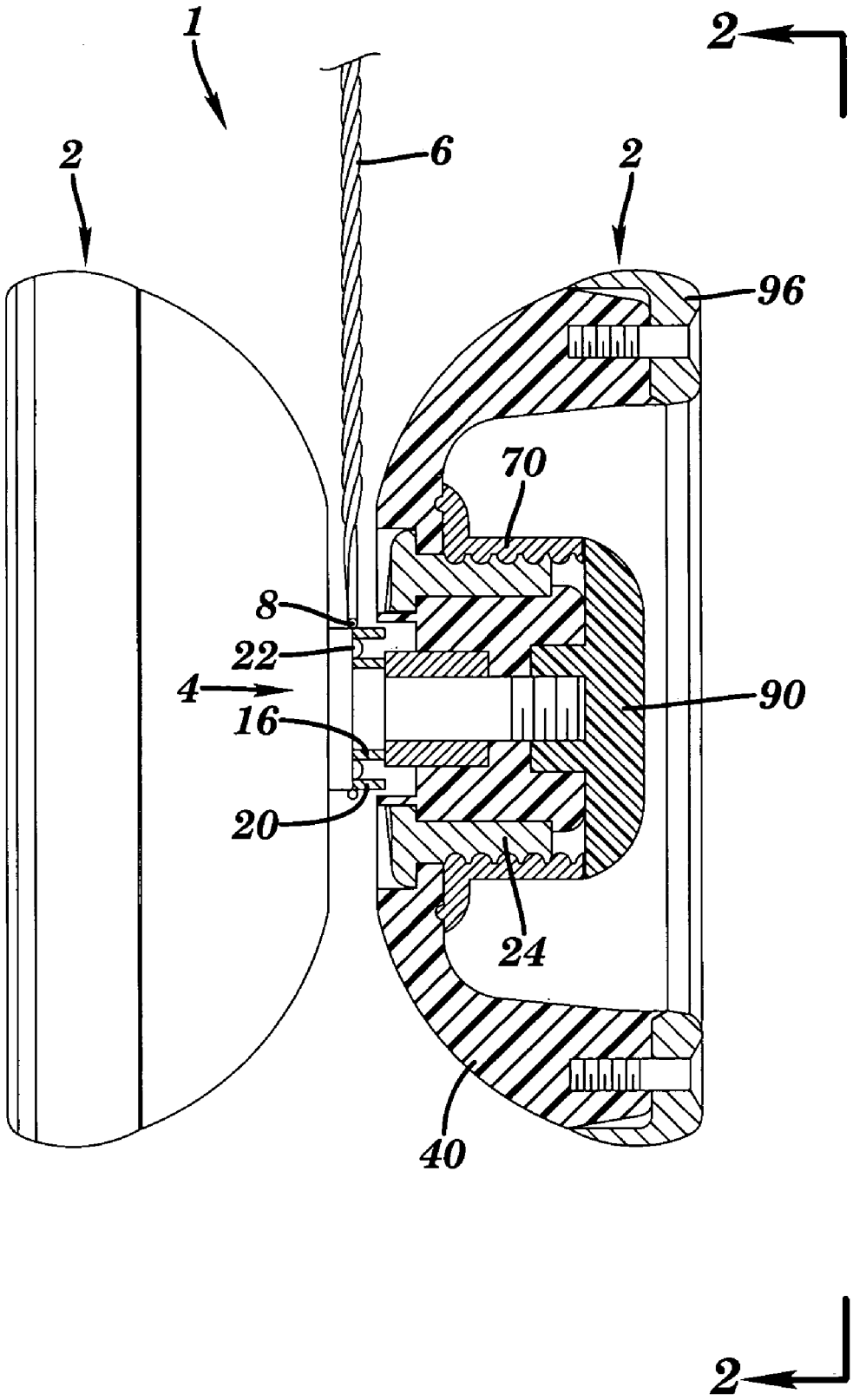
FIG. 1 is a front view of a yo-yo in accordance with the invention, with the right-hand portion of the yo-yo shown in cross-section.

Looking now to the drawings in greater detail, wherein like reference numerals refer to like parts throughout the several figures, there is indicated by the numeral 1 a yo-yo in accordance with the invention.

The yo-yo 1 includes first and second side members 2 that are preferably identical to each other and are connected together via an axle structure 4. A string-type tether 6 includes a loop portion 8 that encircles a center portion of the axle structure. The tether's distal end (not shown) will normally be tied to create a loop that enables a temporary securement of said end to one of a user's fingers.

The axle structure 4 is preferably an assemblage of parts that includes an axle pin 10 (note FIG. 3) and a ball bearing unit 12. The axle pin is preferably in the form of a straight rod that has exterior threads 14 at each end.

The ball bearing unit 12 is preferably conventional in design and comprises an inner race 16 that defines a center opening 18, an outer race 20 and a plurality of ball bearings 22 located between the races. It should be noted that other types of rotatable units or members can be used in lieu of the ball bearing unit shown. Alternatively, the ball bearing unit can be dispensed with when the yo-yo's tether is attached directly to the axle pin, or to a structure fixedly secured to said pin, or to an equivalent structure that connects the side members together.

Each side member 2 includes a shuttle 24 (note FIGS. 1 and 3–5) that has a ring-shaped head portion 26. Portion 26 includes a front, tether engagement surface 28 and a back surface 30. Extending outwardly from locations proximate the periphery of the back surface are three elongated legs 32. A thru-bore 34 extends through the center of portion 26.

The shuttle 24 is preferably a unitary part and is preferably made of a rigid, or substantially rigid, plastic material. Alternatively, the shuttle can be made of other materials, including metal, wood or rubber and/or be a composite or assemblage of rigid and/or non-rigid parts.

To facilitate the return of the yo-yo, the tether engagement surface 28 of each shuttle preferably includes a starburst pattern of raised ribs 36. The ribs function to enhance the ability of surface 28 to snag/engage a portion of the tether when a user makes an appropriate hand movement to cause the yo-yo to return. Alternatively, surface 28 may be featureless or it may have other forms of adaptations to facilitate tether engagement. For example, instead or raised ribs, surface 28 may have an array of indentations, spaced pads/protrusions, movable ribs or be made of a material, such as rubber, that has a relatively high coefficient of friction. Preferably, both of the yo-yo's shuttles 24 will have identical surfaces 28.

One should note that a portion of the exterior surface of each of the shuttle's legs includes threads in the form of grooves 38. The grooves are fashioned whereby a helical configuration is formed by the grooves in the legs, with spaces in the helix being a result of the spaces between the legs.

Each side member further includes a body portion 40 (note FIGS. 1–3, 6 and 7). The body portion has a center-located thru-bore 42 and three apertures/thru-holes 44 located radially outwardly from said thru-bore 42. Each of said apertures 44 has a shape that matches, but is just slightly larger than, a cross-section of any one of the shuttle's legs 32.

Each body portion 40 also includes a tether-facing surface 46 that surrounds a circular, ring-shaped cavity 50. Cavity 50 includes the previously mentioned apertures 44 and is sized to receive the head portion 26 of the shuttle. The depth of cavity 50 is preferably such that portion 26 of the shuttle can be fully received within said cavity whereby the shuttle's tether engagement surface 28 can be preferably coplanar with, or recessed in, said tether-facing surface 46 of the body portion (note FIG. 1). Preferably, the amount of recess should enable any of the shuttle's tether engagement members, such as the raised ribs 36, to be located so that they do not protrude outwardly beyond a plane formed by surface 46.

Figure 3:
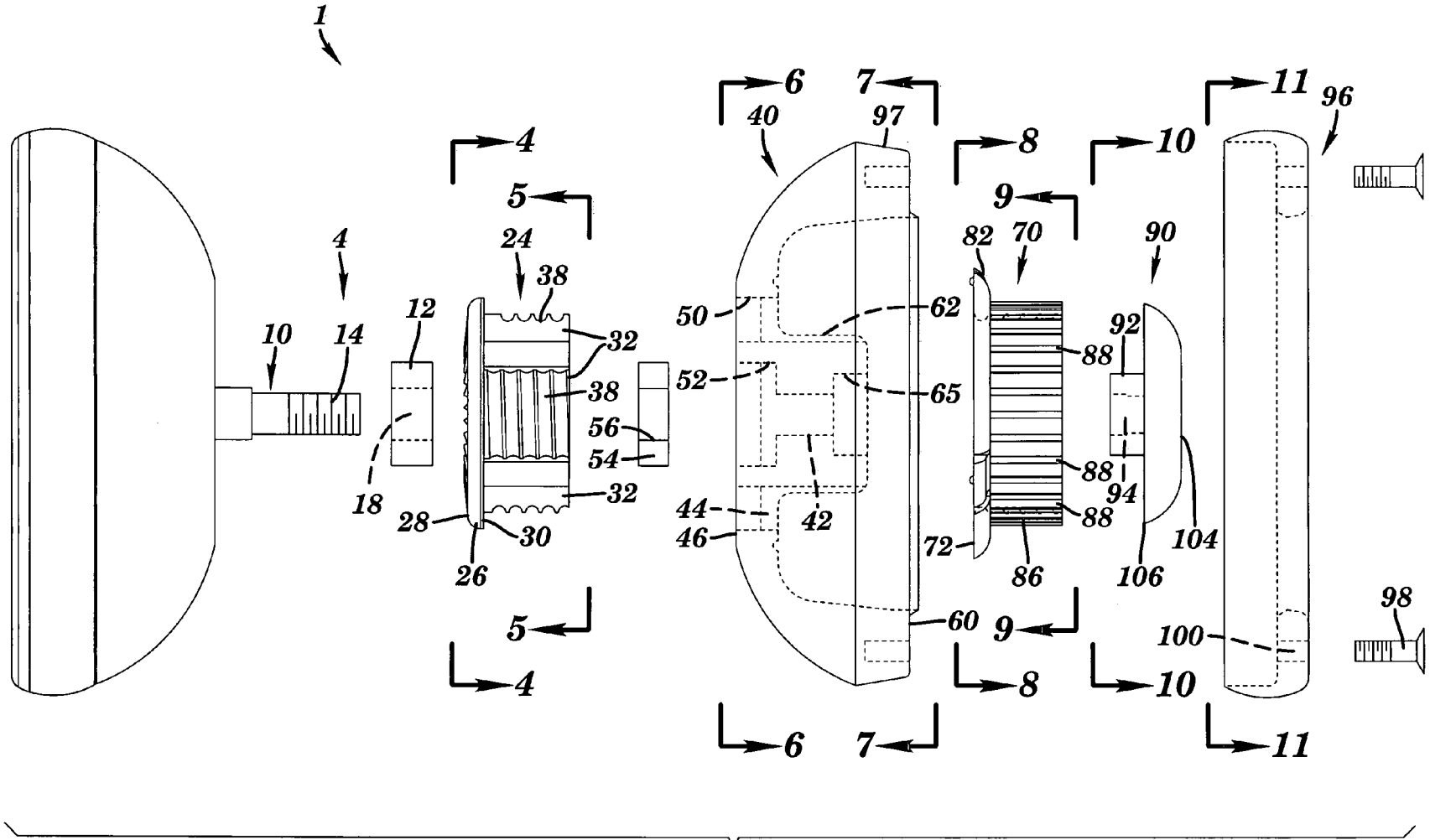
FIG. 3 is a front view of the yo-yo shown in FIG. 1, with the right-hand portion shown in exploded fashion.
Figure 5:
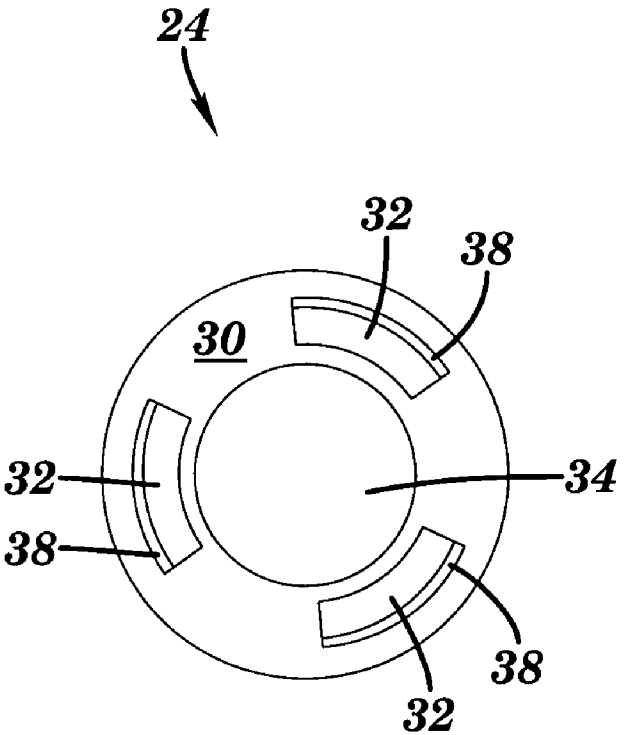
FIG. 5 is a right-side view showing the outwardly-facing surface of the shuttle shown in FIG. 4, taken at the plane labeled 5—5 in FIG. 3.
Figure 4:
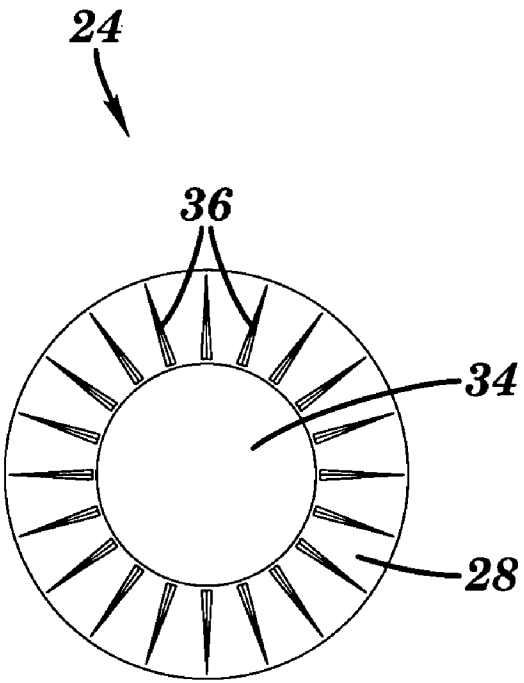
FIG. 4 is a left-side view showing the tether engagement surface of one of the shuttles of the yo-yo shown in FIG. 1, taken at the plane labeled 4—4 in FIG. 3.

Located at the center of cavity 50 is a hexagonally-shaped cavity 52 that is designed to receive a hex nut 54 (note FIG. 3). Nut 54 has a thru-bore 56 that includes threads complementary to threads 14 of the axle pin. The nut preferably has a size and shape so that it can be lockably received into cavity 52. It should be noted that nuts of other shapes may be employed, whereby said cavity 52 would preferably be shaped to match the shape of the nut. Hex nut 54 is preferably made of a metal material, but may also be made of other materials, such as plastic or wood.

Figure 2:
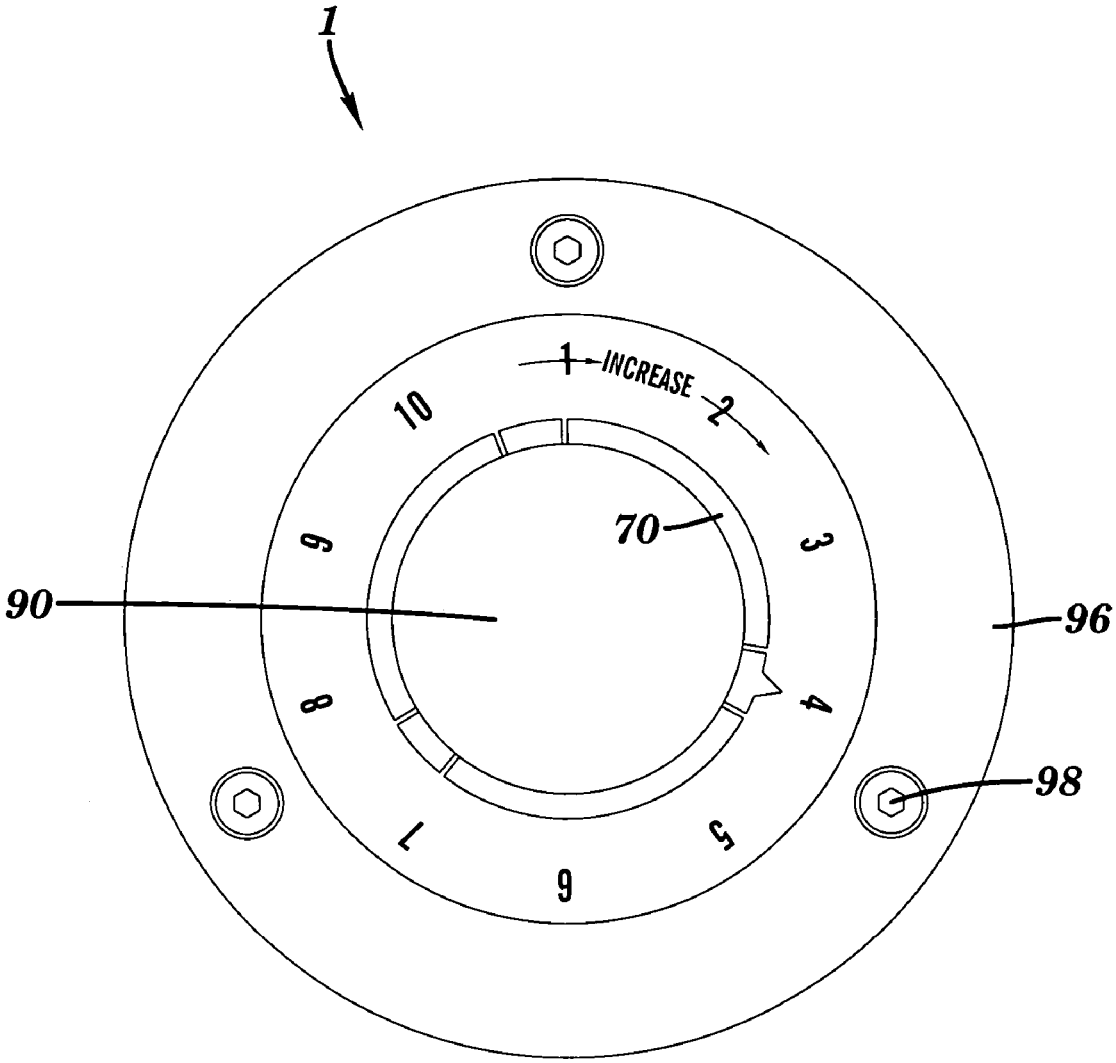
FIG. 2 is a side view of the yo-yo shown in FIG. 1.
Figure 7:
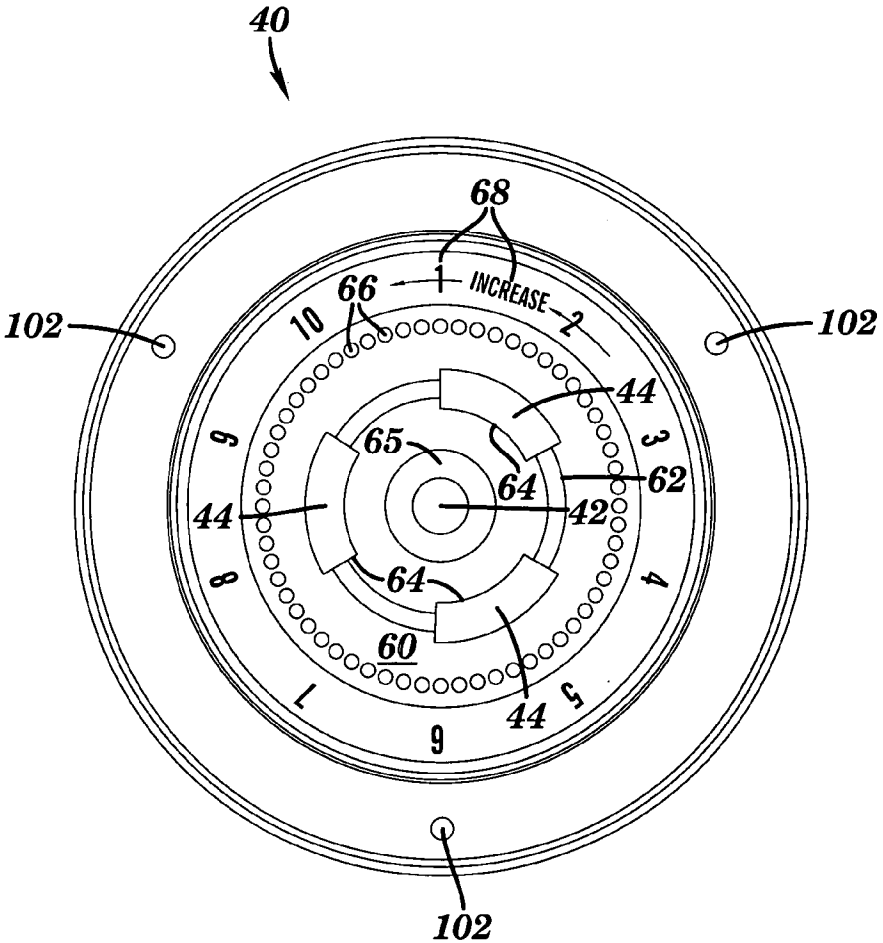
FIG. 7 is a right-side view showing the outwardly-facing surface of the side member body portion shown in FIG. 6, taken at the plane labeled 7—7 in FIG. 3.
Figure 6:
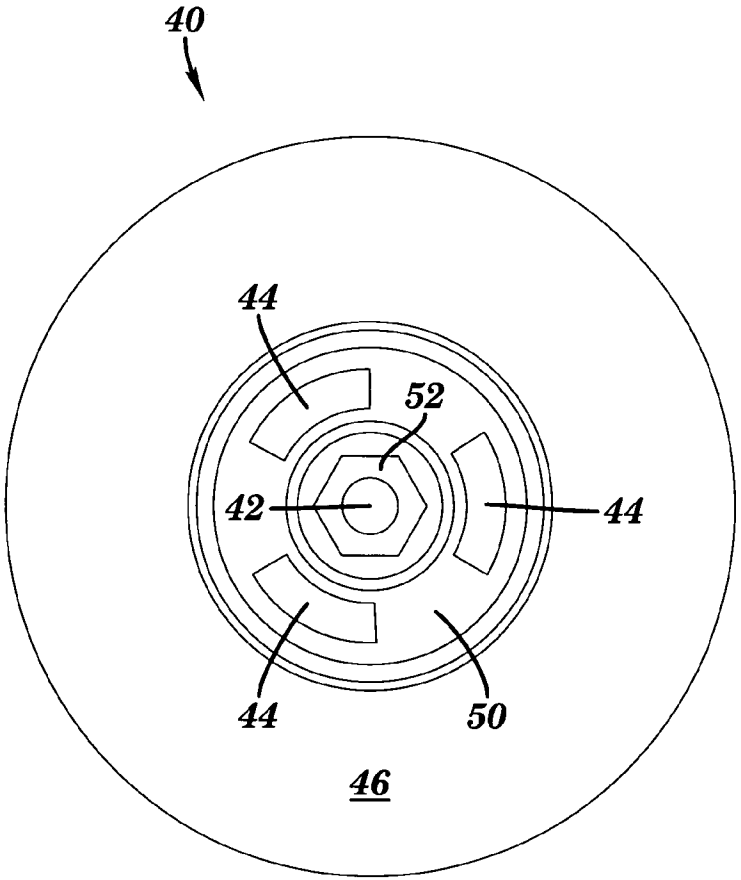
FIG. 6 is a left-side view showing the inwardly-facing surface of one of the side member body portions of the yo-yo shown in FIG. 1, taken at the plane labeled 6—6 in FIG. 3.
Figure 9:
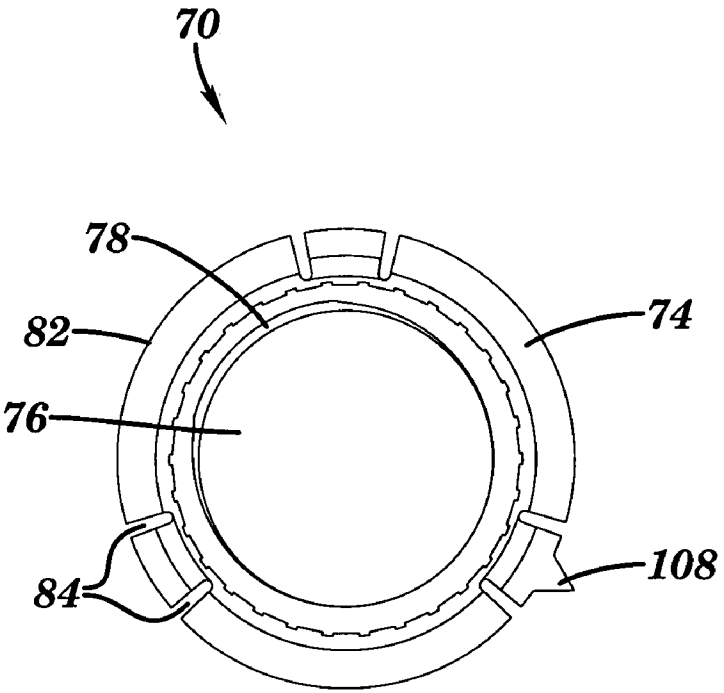
FIG. 9 is a right-side view showing the outwardly-facing surface of the adjustment nut shown in FIG. 8, taken at the plane labeled 9—9 in FIG. 3.
Figure 8:
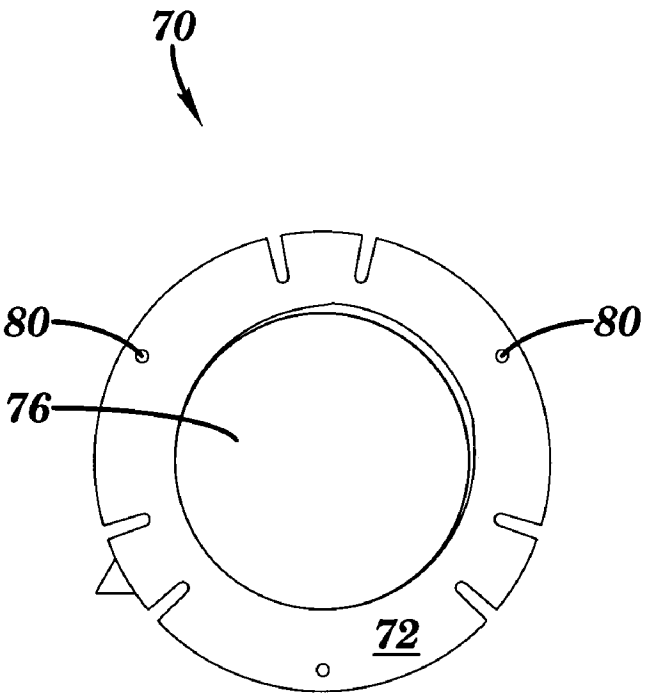
FIG. 8 is a left-side view showing the inwardly-facing surface of one of the adjustment nuts of the yo-yo shown in FIG. 1, taken at the plane labeled 8—8 in FIG. 3.
Figure 10:
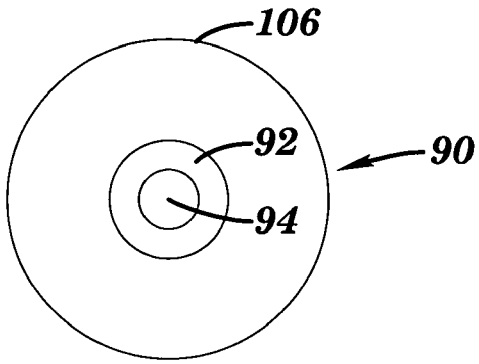
FIG. 10 is a left-side view showing the inwardly-facing surface of one of the caps of the yo-yo shown in FIG. 1, taken at the plane labeled 10—10 in FIG. 3.
Figure 11:
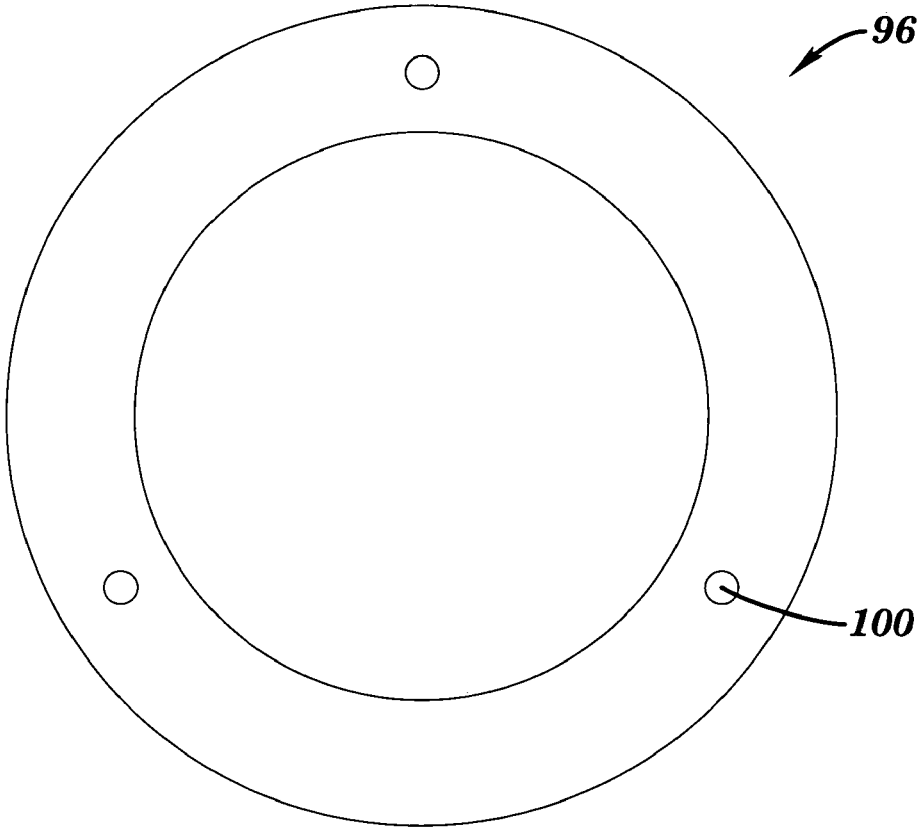
FIG. 11 is a left-side view showing the inwardly-facing surface of one of the removable weight rings of the yo-yo shown in FIG. 1, taken at the plane labeled 11—11 in FIG. 3.

As can be seen in FIGS. 2, 3 and 7, the outwardly-facing surface 60 of each body portion includes an outwardly extending nipple 62 (also referred to herein as a nipple portion). The nipple includes three elongated slots 64 that are an extension of the apertures 44. The distal end of the nipple includes a center-located, circular cavity 65. It should be noted that thru-bore 42 extends through the center of the nipple.

The outwardly-facing surface 60 of the body portion also includes at least one indentation 66. In the embodiment shown, a plurality of indentations 66 are positioned in a circular array. Located on said surface and positioned radially outwardly of the indentations 66 are indicia 68. The indicia are located whereby they are clearly readable when the yo-yo is in an assembled condition.

Located adjacent the outwardly-facing surface of the body portion is an adjustment nut 70 (note FIGS. 1–3, 8 and 9). The adjustment nut includes an inwardly-facing surface 72, an outwardly-facing surface 74 and a center-located thru-bore 76. The thru-bore has a diameter that is just slightly greater than the outer diameter of the body portion's nipple and includes interior threads 78.

The inwardly facing surface of the adjustment nut features a plurality of protuberances/bumps 80. The protuberances/bumps 80 are located, sized and shaped to enable them to fit into the indentations 66 located in the outwardly-facing surface of the body portion.

End portion 82 of the adjustment nut preferably includes a plurality of radially-oriented, elongated cut-outs/slots 84. The cut-outs function to increase the flexibility of portion 82.

One should note that the exterior surface of the main portion 86 of the adjustment nut preferably includes a plurality of longitudinally extending ridges 88. The ridges function to facilitate grasping and turning of the adjustment nut by a user's hand.

Located adjacent and outwardly of the adjustment nut is a retaining cap 90 (note FIGS. 1–3 and 10). The cap includes an elongated nipple portion 92 that has a center-located bore 94. The cap, or at least the distal end of its nipple portion 92, is preferably made of a semi-resilient material such as nylon, or a resilient material such as rubber. It should be noted that the cap's nipple portion preferably has an exterior diameter approximately equal to, or slightly larger than, that of cavity 65 located in the end of the body portion's nipple. Furthermore, the bore 94 of the cap's nipple portion is preferably slightly smaller than the diameter of the end of the axle pin 10 and may include threads (not shown) that are complementary to the threads 14 located on the ends of the axle pin.

In the preferred embodiment, the yo-yo's body portion 40, proximate its periphery, is designed to removably receive a ring member 96 (note FIGS. 1–3 and 11). The ring member is held adjacent to an inclined surface 97 of the body portion by a plurality of allen screws 98 that fit through apertures 100 in the ring member and threadedly engage threaded bores 102 in the body portion 40. Other equivalent fasteners, or fastening systems, may be employed in lieu of the screws 98 shown. The inclined surface 97 preferably creates a small gap between itself and the ring member to thereby enable, and allow for, relative dimensional changes due to thermal expansion or contraction. Both side members will preferably employ ring members made of the same material and having substantially identical weights and shapes. The ring members can have other shapes than those that are shown in the figures. For example, the ring members can have an arcuate shape whereby once they are attached to the yo-yo 1, they give the yo-yo a shape similar to that of a conventional "butterfly" yo-yo. In addition, the ring members can be made of a soft, or hard, material and/or be made of a heavy, or light, material.

When a yo-yo 1 is assembled, the ball bearing unit 12 is first centered on the axle pin 10 with said pin extending through the bearing's center opening 18. Next, each side member is assembled.

The first step in assembling one of the side members 2 is to press a hex nut 54 into the cavity 52 of a body portion 40. It should be noted that other methods for securing the nut to the body portion, such as the use of adhesives or sonic welding, may alternatively be employed. The hex nut is sized and/or shaped whereby when it is seated in the cavity 52 and the yo-yo is fully assembled, it can contact the inner race 16 of bearing 12, but cannot contact the bearing's outer race 20. It should be noted that the design of the yo-yo is such that the bearing's outer race does not contact either of the body portions once the yo-yo is assembled. In this manner, said race may spin freely relative to, and independently of, the yo-yo's side members.

Next, a shuttle 24 is inserted into what will be the tether-facing side of the body portion, with the ends of the shuttle's legs fitting into, and through, the apertures 44. The shuttle is preferably inserted until its head portion 26 is received within the body portion's cavity 50 and its legs extend into the slots 64 in the body portion's nipple 62. It should be noted that once the shuttle is properly located in the body portion, the outer side portion of each leg having the grooves 38 faces outwardly from the slots in the nipple and preferably protrudes a slight distance outwardly from the surrounding exterior surface of the nipple 62.

In the next step, an adjustment nut 70 is placed onto the nipple 62 of the body portion whereby the nut's surface 72 faces the body portion and the distal end of the body portion's nipple is located within the nut's thru-bore 76. The nut is then rotated until its interior threads 78 engage the grooves 38 of the shuttle's legs. The rotation of the nut is continued until the nipple portion extends completely through the nut's thru-bore. Once the nut is rotated to a position where it abuts the outwardly-facing surface of the body portion, rotation of the nut causes the bumps 80 on surface 72 of the nut to slide into, and then out of, the indentations 66 in the body portion. It should be noted that the cut-outs 84 in the end portion 82 of the nut enhance the flexibility of said portion. Said portion then acts like a spring whereby a detent is created each time the bumps become seated in the indentations.

One then attaches a cap 90 to the end of the body portion's nipple. This is accomplished by inserting the end of the cap's nipple portion 92 into the cavity 65 located at the end of the body portion's nipple. There is preferably a very slight interference fit between the sidewall of the cavity 65 and the exterior of the cap's nipple portion. Therefore, one forcibly pushes the cap's nipple portion into cavity 65 by applying pressure against the outer surface 104 of the cap. This could be done by machine, but is preferably done by hand whereby the force required is low enough so that a user can, if desired, pull the cap free from the body portion. Once the cap's nipple portion is pressed into place, the cap is non-rotatable relative to the nipple and the outer periphery 106 of the cap acts to retain the adjustment nut on the nipple.

Finally, a ring member 96 is preferably attached to the perimeter of the body portion through the use of alien screws 98. The ring member is preferably placed in position on the body portion and each allen screw is fitted through one of the apertures 100 in the ring member and threaded into the complementary threads of one of the bores 102 in the body portion. It should be noted that the ring members are optional and may not be included on the yo-yo 1.

Once both side members have been assembled, each side member is threaded onto an opposite end of the axle pin via their hex nuts 54 engaging threads 14. Each body portion is rotated relative to the axle pin until its hex nut is proximate the bearing unit.

The thru-bore 94 of each side member's cap 90 is sized whereby the threads 14 of the axle pin deformably engage the thru-bore of the cap. Since each cap is pressed into the side member's body portion in a preferably non-rotatable manner, the engagement between the axle pin and the cap acts to increase the torque required to rotate the associated side member 2 relative to the axle pin, and to the other side member. This provides a mechanism for a secure adjustable string gap in which one can change the distance between the yo-yo's two side members by rotation of one side member relative to the other side member.

Disassembly of the yo-yo can be accomplished by reversing the previously described method of assembly. One should note that the ring members 96 can be removed, and replacements installed, without a full disassembly of the yo-yo.

It should be noted that since the cap 90 substantially prevents the adjustment nut from moving longitudinally on the nipple 62, rotation of said nut causes the shuttle, via its legs' engagement with the interior threads 78 of the nut, to move longitudinally. It should also be noted that the cap causes the nut to press into surface 60 of the body portion whereby rotation of the nut causes its bumps 80 to move into, and then out of, the complementary indentations 66 in surface 60. In this manner, whenever the bumps are moved into the indentations, a locking engagement/detent occurs that preferably is accompanied by an audible clicking sound at each point when the nut's position is locked. The locking engagement prevents the nut from inadvertently rotating and changing the yo-yo's responsiveness setting.

Once the yo-yo 1 is in an assembled condition, a user can adjust the yo-yo's responsiveness in a number of ways. The primary adjustment mechanism is through adjustment of the position of each side member's shuttle 24.

Figure 12:
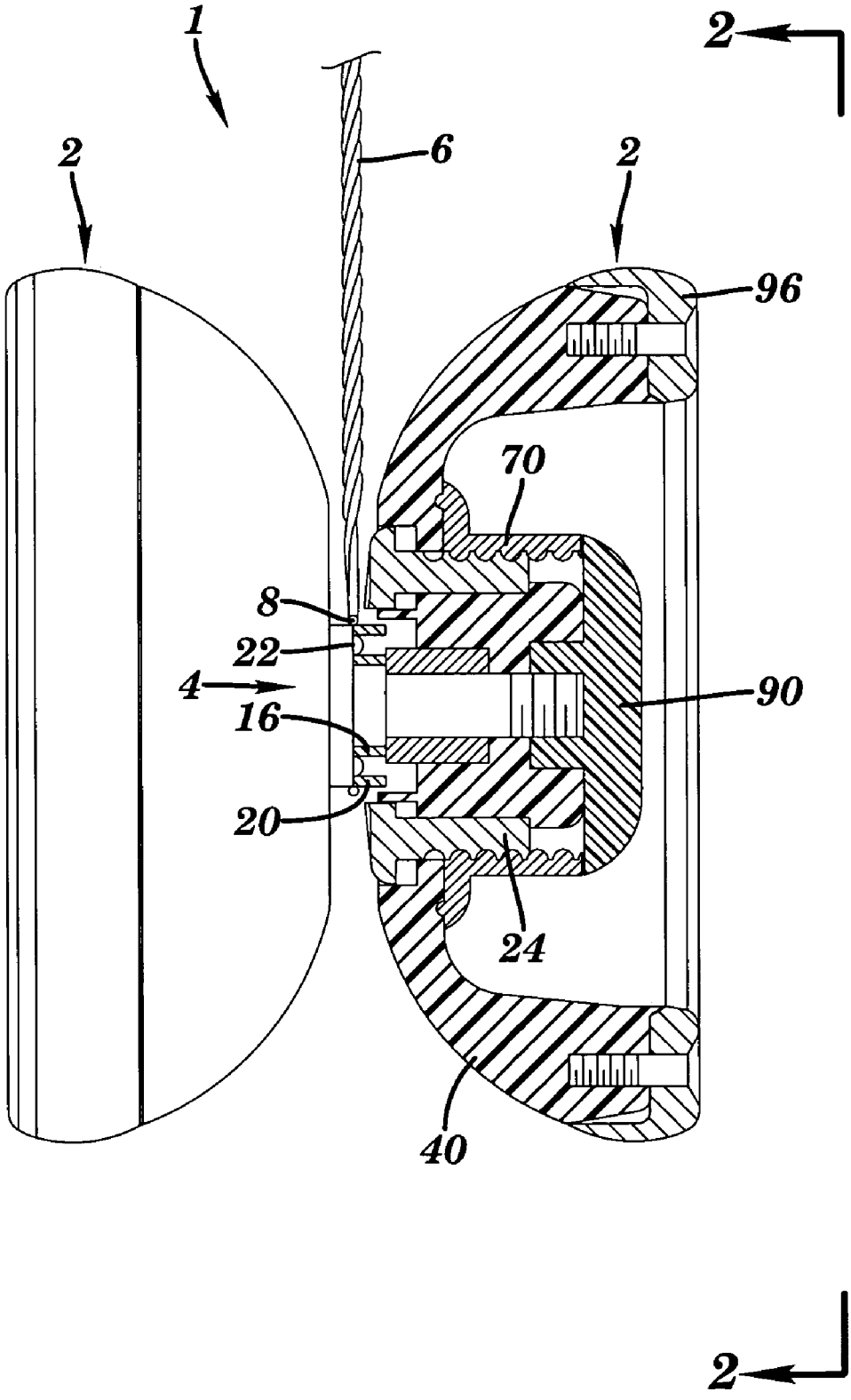
FIG. 12 is a view of the yo-yo shown in FIG. 1, but at a point when the shuttles are positioned closer to the yo-yo's tether than is shown in FIG. 1.

To adjust a shuttle's position, a user rotates the adjustment nut 70. Preferably, when the nut is turned in a clockwise direction, the associated shuttle's tether engagement surface 28 is moved closer to the tether. Since the tether would then have less distance to travel to snag on/engage one of the ribs 36 of the shuttle's surface 28, this causes an increase in the yo-yo's responsiveness. This result is seen in FIG. 12 wherein the nut has been rotated and the shuttle has moved to a second position from the first position shown in FIG. 1. A counterclockwise rotation of the nut will have the opposite action and effect.

As can be seen in FIGS. 2 and 7, surface 60 of the body portion preferably includes indicia 68. The indicia function to indicate to the user the direction that one should rotate the nut to cause the yo-yo's responsiveness to change in a manner specified/suggested by the indicia. As shown, one would rotate the nut in a clockwise direction in order to increase the yo-yo's responsiveness. Preferably, the nut includes a molded-in arrow 108, or equivalent structure or markings, that can be used in combination with the indicia 68 to enable a user to determine the yo-yo's responsiveness setting. A user wishing to increase the yo-yo's responsiveness from the position shown where the arrow is pointing at the numeral four would rotate the nut clockwise until the arrow is pointing at a higher numeral, such as the numeral five, or at least at a numeral located further clockwise from the original setting. It should be noted that the detents are preferably associated with the indicia whereby the nut will positionally lock at each point where the arrow is pointing at one of the numeral indicia.

As noted previously, the yo-yo 1 optionally, but preferably, includes secondary methods for affecting its responsiveness and/or changing its performance related physical characteristics. These methods can be used in combination with the movable shuttles to increase the versatility of the yo-yo.

Firstly, a user can replace the yo-yo's shuttles with another set of shuttles that have a different tether engagement surface. Replaceable shuttles also allow a user to restore a yo-yo's performance by replacing parts that have become worn through engagement with the tether. In addition, the use of replaceable shuttles even enables a user to modify the yo-yo 1 for off-string tricks in which the tether is disconnected from the axle structure. For example, if the yo-yo 1 has shuttles having tether engagement surfaces that feature raised ribs, a user can remove those shuttles and replace them with shuttles that have dimpled tether engagement surfaces that are ideally suited for off-string use of the yo-yo.

Secondly, a user can change the string gap of the yo-yo 1 via rotation of one side member relative to the other. This is enabled via the hex nuts 54 being engaged to the axle structure in combination with the caps' deformable nipple portions engaged to the threaded ends of the axle pin.

Thirdly, a user can replace the yo-yo's ring members with another set of ring members that have different weights and/or shapes and/or are made from a different material. It should be noted that other performance characteristics of the yo-yo resulting from the yo-yo's shape can be changed via changing ring members. For example, the yo-yo's ability to flip over can be enhanced by removing a set of ring members that give the yo-yo a butterfly shape with a set of ring members that give it the traditional yo-yo shape shown in FIG. 1.

It should be noted that by having the yo-yo 1 include a plurality of methods for adjusting its responsiveness and/or performance related physical characteristics, a user can combine the different methods and produce a yo-yo ideally suited for performing a much wider range of tricks than any one yo-yo in the prior art. The yo-yo's design also enables replacement of worn parts and use by both beginning and experienced yo-yo players.

It should also be noted that the use of a user positionable shuttle, as taught herein, can be employed with other types of yo-yos than the one shown. For example, the system can facilitate tether engagement in yo-yos having other types of axle structures, or shapes of side members. Furthermore, while the yo-yo shown employs a movable shuttle in both side members, it is within the scope of the invention to employ a movable shuttle in only one side member whereby the other side member may include a fixed tether engagement surface that has, or does not have, any particular type or form of tether engagement adaptation(s).

The preferred embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A yo-yo comprising:

first and second side members secured together in a spaced-apart relation by an axle structure;

a tether secured to a portion of said axle structure; and wherein said first side member includes a body portion that has an inwardly-facing surface that faces toward said tether and an outwardly-facing surface that faces away from said tether, wherein said first side member also includes a shuttle and an adjustment nut, wherein said shuttle includes a tether-facing portion having a tether engagement surface capable of engaging said tether, wherein said shuttle is movably secured to said body portion by said adjustment nut, wherein said adjustment nut is rotatably fixed on said body portion, wherein said adjustment nut is rotatably engaged to said shuttle in a manner whereby when said shuttle is in a first position, rotation of said nut in a first direction pushes on, and thereby moves, said shuttle to a second position in which the shuttle's tether engagement surface is located closer to said tether, and wherein if said shuttle is in said second position and said nut is rotated in a second, opposite direction, said nut pulls on, and thereby moves, said shuttle in a manner whereby the shuttle's tether engagement surface moves away from said tether.

2. The yo-yo of claim 1 wherein said shuttle also includes a plurality of legs that extend in a direction away from said tether and pass through apertures in said body portion.

3. The yo-yo of claim 2 wherein a portion of at least one of said legs includes exterior grooves that are engaged to a threaded bore of said adjustment nut, and wherein said engagement enables said movement of said shuttle when said nut is rotated.

4. The yo-yo of claim 2 wherein the legs of said shuttle extend into, and protrude outwardly from, elongated slots in an outwardly extending nipple portion of said body portion.

5. The yo-yo of claim 4 wherein said first side member also includes a cap member that is releasably secured to said nipple portion of said body portion and functions to fix said adjustment nut on said body portion in a manner whereby said adjustment nut can be rotated on said nipple portion but is restrained from moving longitudinally on said nipple portion.

6. The yo-yo of claim 5 wherein said nipple portion features an end-located opening into which a portion of the cap member is received.

7. The yo-yo of claim 6 wherein said portion of said cap member received within the end-located opening of said nipple portion is non-rotatably engaged to said nipple portion, is made of a deformable material and has an inner bore, and wherein said axle structure includes a portion that extends into said inner bore of said cap member and thereby engages said cap member, wherein said engagement between said axle structure and said cap member causes to increase a torque required to rotate the first side member on said axle structure.

8. The yo-yo of claim 1 wherein said tether engagement surface of said shuttle includes adaptations that facilitate a snagging engagement between said surface and said tether.

9. The yo-yo of claim 8 wherein said adaptations are in the form of a plurality of members that extend out of said surface toward said tether.

10. The yo-yo of claim 9 wherein said adaptations are in the form of elongated rib members that are oriented in a starburst-shaped array.

11. The yo-yo of claim 1 wherein a portion of said first side member includes indicia that indicates to a user the direction to which said adjustment nut should be rotated to cause the yo-yo's responsiveness to change in a predetermined manner.

12. The yo-yo of claim 11 wherein said indicia is located on said body portion on a surface that faces away from said tether.

13. The yo-yo of claim 1 wherein a portion of said adjustment nut includes an indicator, wherein a portion of said first side member includes indicia, wherein when said adjustment nut is in a first position, a user can look at said indicator and compare it to said indicia and thereby be provided with an indication of how easy the yo-yo will be to return on command, and wherein when the adjustment nut is in a second position, a user can look at said indicator and compare it to said indicia and thereby be provided with an indication of how changing the position of said adjustment nut has changed how easy the yo-yo will be to return on command.

14. The yo-yo of claim 1 wherein free rotation of said adjustment nut is hampered by a plurality of detents in which each detent provides a locking engagement between a portion of said nut and another portion of said first side member.

15. The yo-yo of claim 14 wherein each detent is created by a portion of the adjustment nut engaging a complementary portion of said body portion.

16. The yo-yo of claim 1 wherein said first side member further includes a ring member removably secured to said body portion and located proximate a peripheral portion of said body portion.

17. The yo-yo of claim 16 wherein securement of said ring member is via a plurality of threaded members that extend through complementary bores in said ring member and engage threaded bores located in a portion of said body portion.

18. The yo-yo of claim 1 wherein said first side member also includes a cap member that is secured to said body portion and functions to secure said adjustment nut to said body portion.

19. The yo-yo of claim 1 wherein a center-located bore of said adjustment nut has threads that engage complementary grooves in said shuttle.

20. The yo-yo of claim 1 wherein said first and second side members are substantially identical.

21. A toy for use with a tether, said toy comprising:

first and second side members secured together in a spaced-apart relation by an axle structure, and wherein a string gap area is located between said side members;

wherein said first side member includes a body portion, a shuttle and an adjustment nut, wherein said shuttle includes a surface that faces said string gap area and is capable of engaging a tether when said tether is located in said area, wherein said shuttle is movably secured to said body portion by said adjustment nut, wherein said adjustment nut is rotatably secured to said body portion and is rotatably engaged to said shuttle in a manner whereby rotation of said nut in a first direction can push on, and thereby move, said shuttle closer to a center of said string gap area, and wherein rotation of said nut in a second, opposite direction can pull on, and thereby move, said shuttle away from said center of said string gap area.

22. The toy of claim 21 wherein said first and second side members are substantially identical.

23. The toy of claim 21 wherein a portion of said first side member includes indicia that indicates to a user the direction to which said adjustment nut should be rotated to cause the shuttle to move in a predetermined manner.

* * * * *